US006470773B1

(12) United States Patent
Wu

(10) Patent No.: US 6,470,773 B1
(45) Date of Patent: Oct. 29, 2002

(54) ADJUSTABLE WRENCH OF ELIMINATING THE CLEARANCE OF ADJUSTING JAW

(76) Inventor: Arthur Wu, No. 22, Alley 28, Lane 360, Chung Shan Rd., She Kou Village, Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/967,969

(22) Filed: Oct. 2, 2001

(51) Int. Cl.[7] ..... B25B 13/16
(52) U.S. Cl. ..... 81/165
(58) Field of Search ..... 81/129, 129.5, 81/165, 170

(56) References Cited

U.S. PATENT DOCUMENTS 2,722,150 A * 11/1955 Green ..... 81/165
3,183,744 A * 5/1965 Bowman ..... 81/165
4,449,431 A * 5/1984 Brunosson ..... 81/165
5,331,868 A * 7/1994 Elmore ..... 81/165

* cited by examiner

*Primary Examiner*—Eileen P. Morgan
*Assistant Examiner*—Joni B. Danganan
(74) *Attorney, Agent, or Firm*—Browdy and Neimark, P.L.L.C.

(57) ABSTRACT

An adjustable wrench comprises a frame having a handle, a fixed jaw and a guiding slot. An adjusting jaw has a neck at bottom side thereof. The neck receiving in the guiding slot of said frame whereby the adjusting jaw could slide along said guiding slot. An adjusting worm mounts at the frame for driving the adjusting jaw sliding, and a substantially U-shaped elastic piece mounting at one lateral end of the neck of the adjusting jaw. The U-shaped elastic piece has two suspended against portions respectively locating at two sides of the neck of the adjusting jaw whereby the against portions of the U-shaped elastic piece being against on the sidewalls of the guiding slot respectively.

7 Claims, 6 Drawing Sheets

ADJUSTABLE WRENCH OF ELIMINATING THE CLEARANCE OF ADJUSTING JAW

FIELD OF THE INVENTION

The present invention relates generally to an adjustable wrench, and more particularly to an adjustable wrench, which is capable of eliminating the clearance between adjusting jaw and the guiding slot.

BACKGROUND OF THE INVENTION

Adjustable wrenches are a highly used tool for turning nuts and bolts by moving an adjusting jaw of the wrench to meet the specific dimensions. To facilitate the adjusting jaw along a guiding slot of the adjustable wrench, there must be a clearance remaining between the adjusting jaw and the guiding slot. This clearance makes the adjusting jaw incline or tremble in the guiding slot.

An earlier invention of the inventor provided an adjustable wrench, the U.S. patent Ser. No. 09/802,889, which disposed two through holes at the neck of the adjusting jaw. Two rod-shaped packing devices are respectively mounted in the through holes with two ends thereof being engaged on the side walls of the guiding slot of the adjustable wrench. The packing devices eliminates the clearance between the adjusting jaw and the guiding slot to prevent the adjusting jaw from inclining or trembling in the guiding slot, and furthermore, the packing devices provide a friction resistant to prevent the adjusting jaw from trembling.

Inventor has found another way to achieve the same function as the above invention but which is easier to set up and has lower cost.

SUMMARY OF THE INVENTION

The primary objective of the invention is to provide an adjustable wrench, which is capable of eliminating the clearance between the adjusting jaw and the guiding slot.

According to the objective of the present invention, the adjustable jaw comprises a frame having a handle, a fixed jaw and a guiding slot at one end of the handle: an adjusting jaw having a neck received in the guiding slot, means for driving the adjusting jaw along the guiding slot, and at least one elastic piece disposed on the neck of the adjusting jaw. The elastic piece has at least two portions projecting out from the neck which are respectively engaged on the sidewalls of the guiding slot. The elastic piece is capable of eliminating the clearance between the adjusting jaw and the guiding slot.

DETAIL DESCRIPTION OF THE INVENTION

Figure 1:
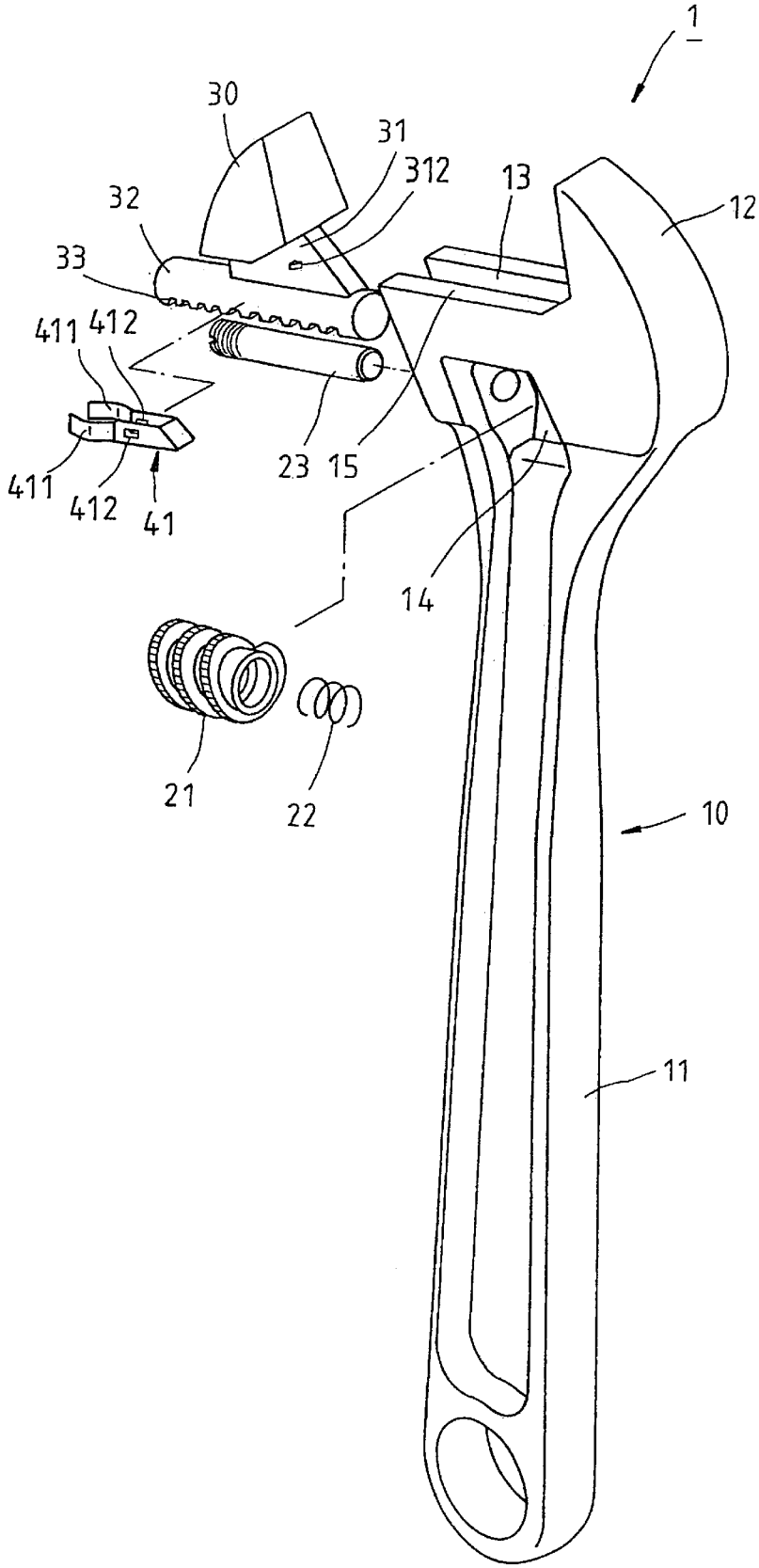
FIG. 1 shows an exploded structure of the first preferred embodiment.
Figure 2:
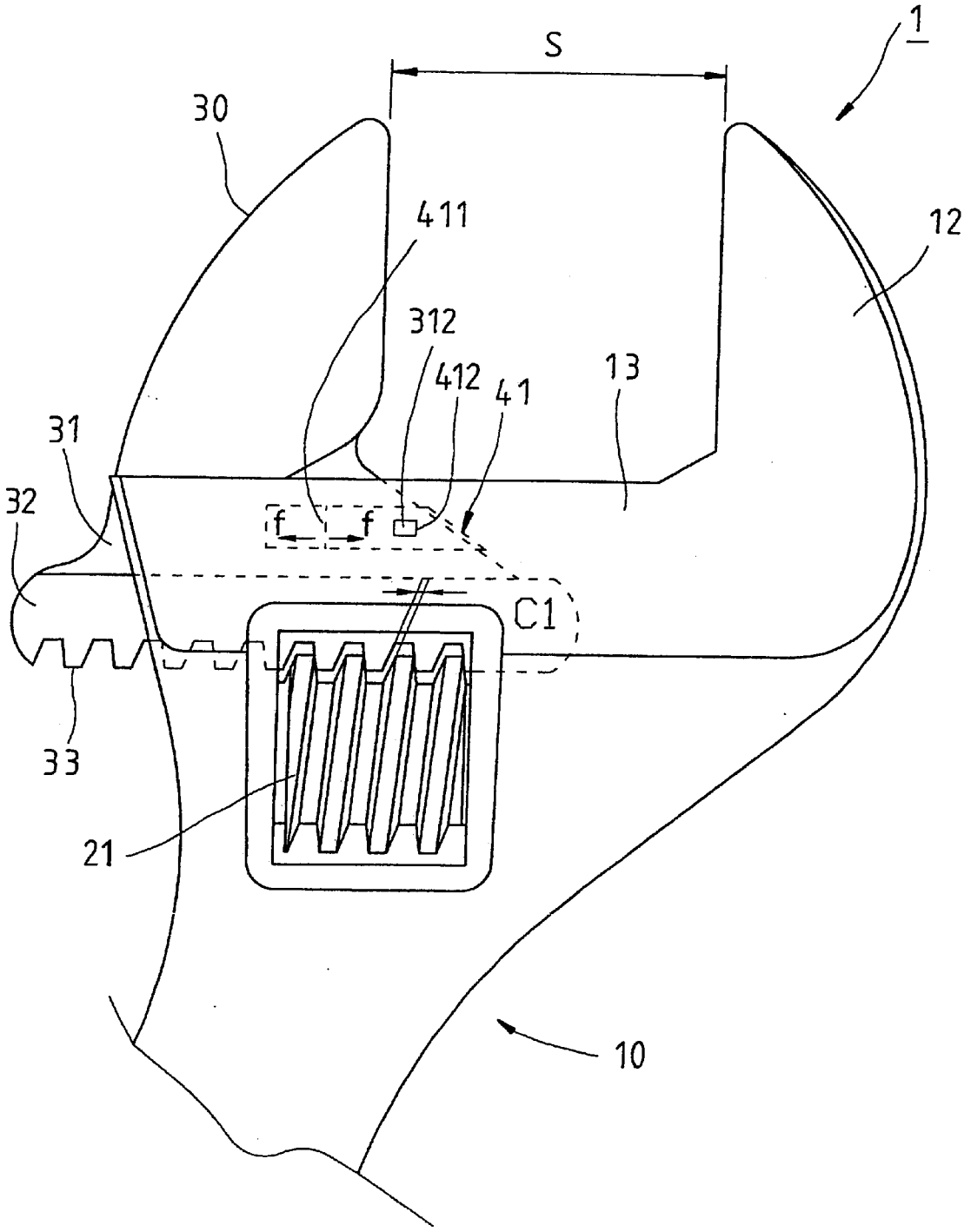
FIG. 2 shows a front side view of the first preferred embodiment.
Figure 3:
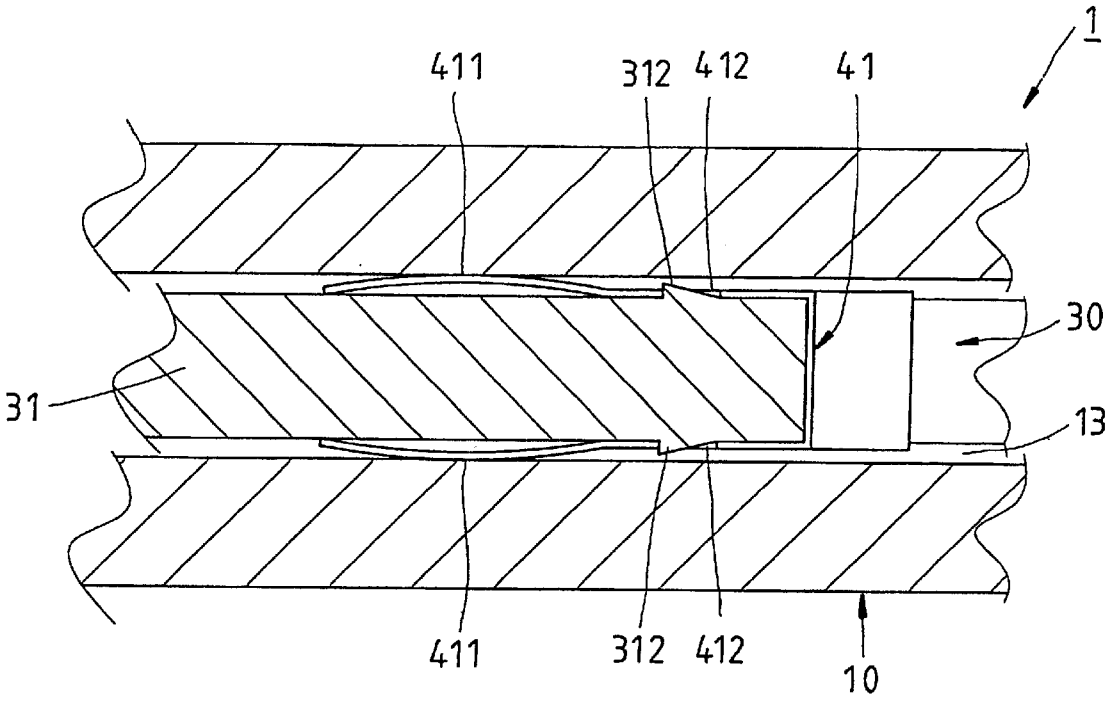
FIG. 3 shows a sectional view from the topside of the first preferred embodiment.

Please refer to FIG. 1 to FIG. 3, wherein an adjustable wrench 1 of the first embodiment of the present invention is shown comprising:

A frame 10 having a handle 11 and a fixed jaw 12 at one end of the handle 11. A guiding slot 13 disposed at one end of the frame 10 on fixed jaw 12. An opening 14 on the frame 10 next to the guiding slot 13. The topside of the opening 14 communicating with the guiding slot 13.

An adjusting worm 21 is engaged in the opening 14 of the frame 10. A spring 22 has one end engaged against one end of the adjusting worm 21, and the other end thereof engaged against the sidewall of the opening 14. A pivot 23 passes through the adjusting worm 21 and the spring 22 on which the adjusting worm 21 in the opening 14 of the frame 10 can rotate.

An adjusting jaw 30 has a neck 31 at the bottom side thereof. A rod-shaped slider 32 is disposed at the bottom end of the neck 31. The slider 32 has a rack 33 at bottom side thereof. Each side of the neck 31 respectively has a block 312 which projects out from neck 3. The neck 31 and the slider 32 are engaged in the guiding slot 13 of the frame 10 and the rack 33 is engaged to the adjusting worm 30. Thus, a user can slide the adjusting jaw 30 along the guiding slot 13 by turning the adjusting worm 30.

A substantially U-shaped elastic piece 41, made of metal or plastic, has two portions 411 projecting out from the elastic piece. Two openings 412 are disposed on the elastic piece 41 next to portions 411. The U-shaped elastic piece 41 is clipped over the neck 31 of the adjusting jaw 30 as shown in FIG. 2. Elastic piece 41 is clipped on so that the blocks 312 of the neck 31 are received in openings 412 to lock the elastic piece 41 on neck 31. The portions 411 are located on opposite sides of the neck 31 and project out from neck 31. The outer sides of portions 411 of the elastic piece 41 are respectively engaged against the sidewalls of the guiding slot 13 of the frame 10 with an elastic force to eliminate the clearance between the neck 31 of the adjusting jaw 30 and the guiding slot 13.

The first embodiment of the present invention has the advantage of a simple mechanism to eliminate the clearance. It is easy to mount the U-shaped elastic piece 41 on the neck 31 of the adjusting jaw 30. Manufacturers have no need to make the U-shaped elastic piece 41 to a precise dimension to meet the clearance between the neck 31 of the adjusting jaw 30 and the guiding slot 13 since the two elastic portions 411 of the elastic piece 41 adjust automatically to meet the clearance.

Figure 4:
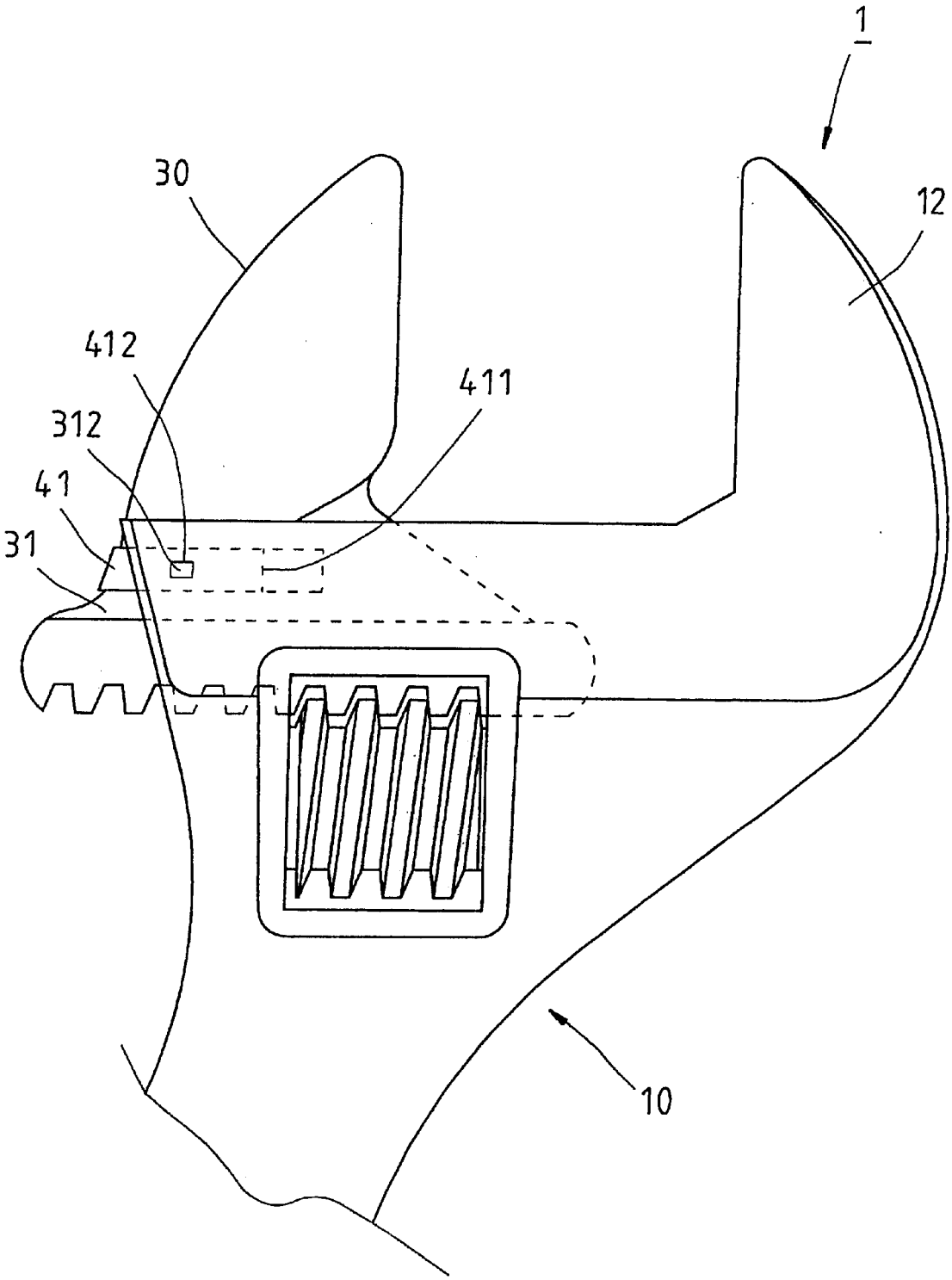
FIG. 4 shows the U-shaped elastic piece mount at the other side of the adjusting jaw.

Some other points about the adjustable wrench 1 of the first embodiment of the present invention are noted hereunder:

1. Mounting the U-shaped elastic piece 41 on the neck 31 of the adjusting jaw 30 is obvious as shown in FIG. 4.
2. As shown in FIG. 2, there always are clearances C1 between the teeth of the rack 33 and the teeth of the adjusting worm 20. Without the use of elastic piece 41, these clearances C1 would make the adjusting jaw 30 tremble along the guiding slot 13 after being adjusted to a predetermined position. By using elastic piece 41, portions 411 of the elastic piece 41 provide a friction resistant along the sliding direction of the adjusting jaw 30 to prevent such trembling.

Figure 6:
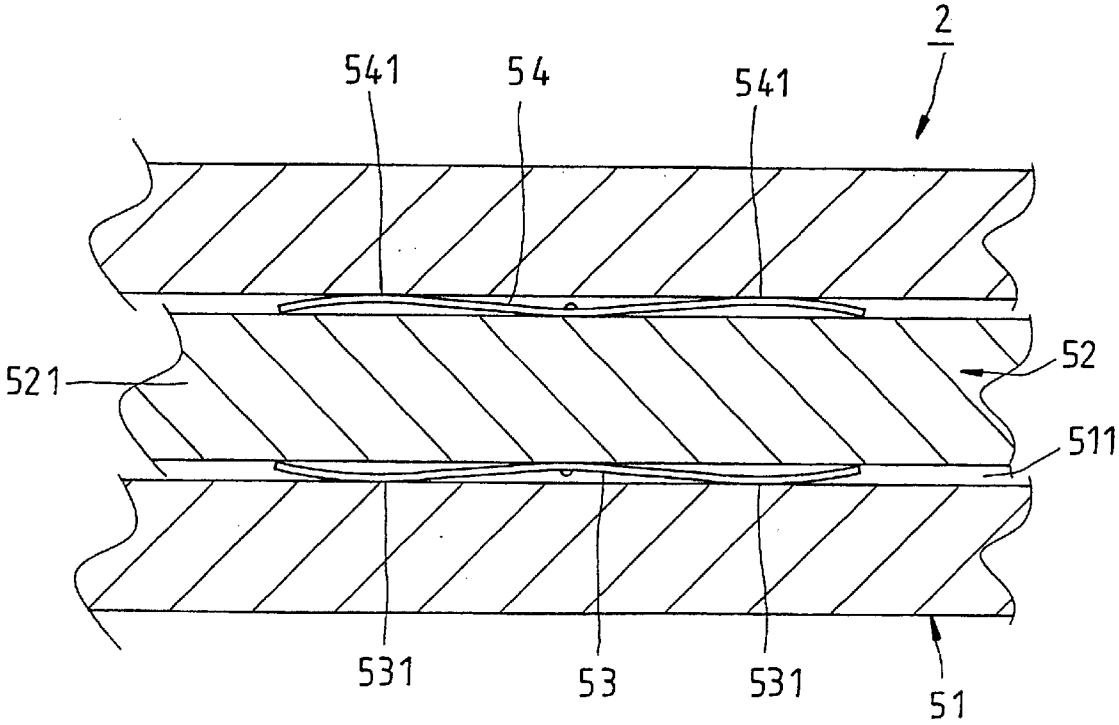
FIG. 6 shows a sectional view from the topside of the second preferred embodiment.
Figure 5:
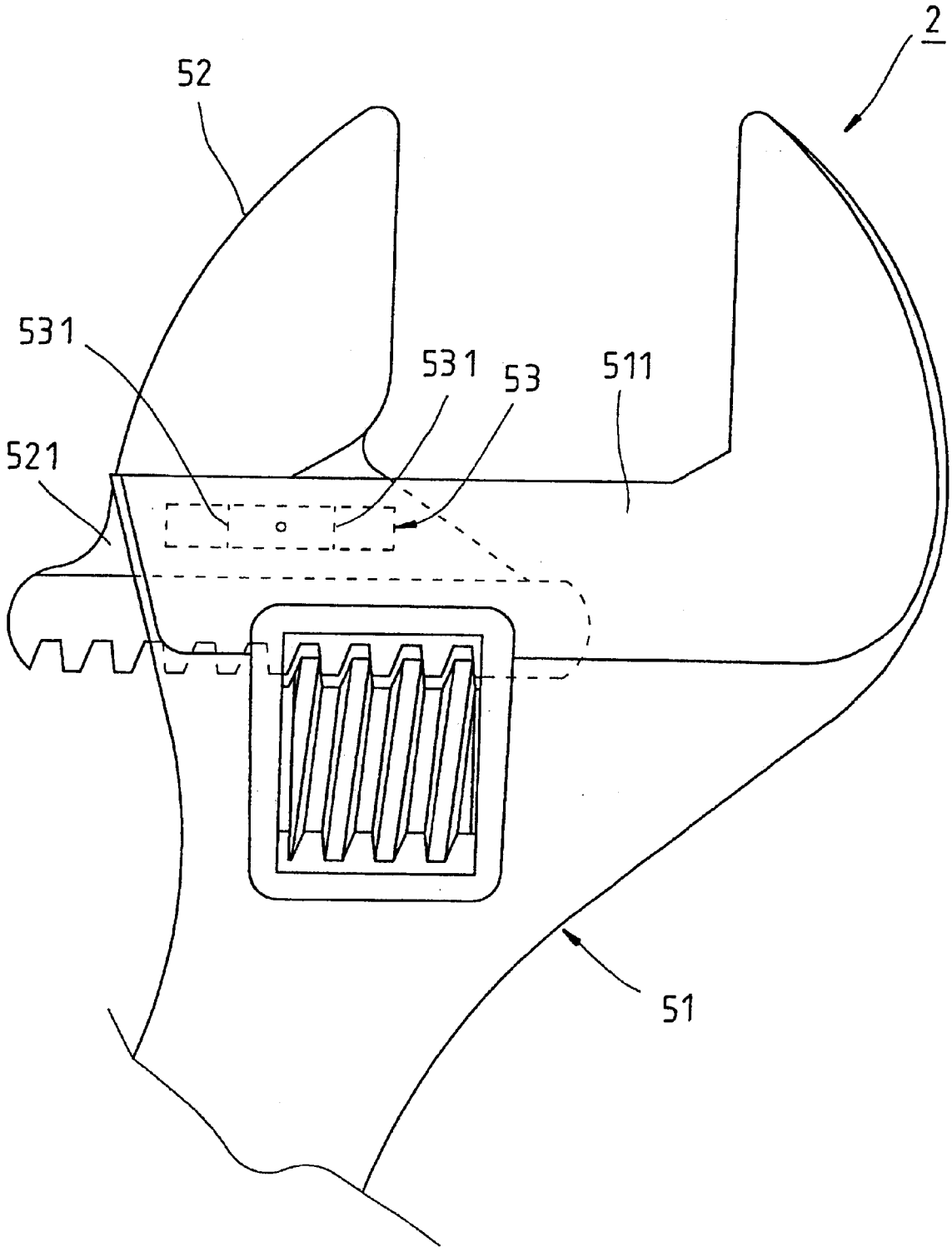
FIG. 5 shows a front side view of the second preferred embodiment.

FIG. 5 and FIG. 6 show a second embodiment of the present invention comprising a frame 51 having a guiding slot 511 and an adjusting jaw 52 engaged in the guiding slot 511. The adjustable wrench 2 has two substantially flat metal elastic pieces 53 and 54 respectively fix at two sides of a neck 521 of adjusting jaw 52 of the adjustable wrench 2 by spot welding. The fixing the elastic pieces 53 and 54 to jaw 52 also can be done with adhesive. Each of the elastic pieces 53 and 54 have two arched portions 531 and 541. The portions 531 and 541 of the elastic pieces 53 and 54 respectively projecting out from neck 521 against the sidewalls of a guiding slot 511 of a frame 51 of the adjustable wrench 2. The flat elastic pieces 53 and 54 of the second embodiment have the same function and advantages as the U-shaped elastic piece 41 of the first embodiment.

Figure 7:
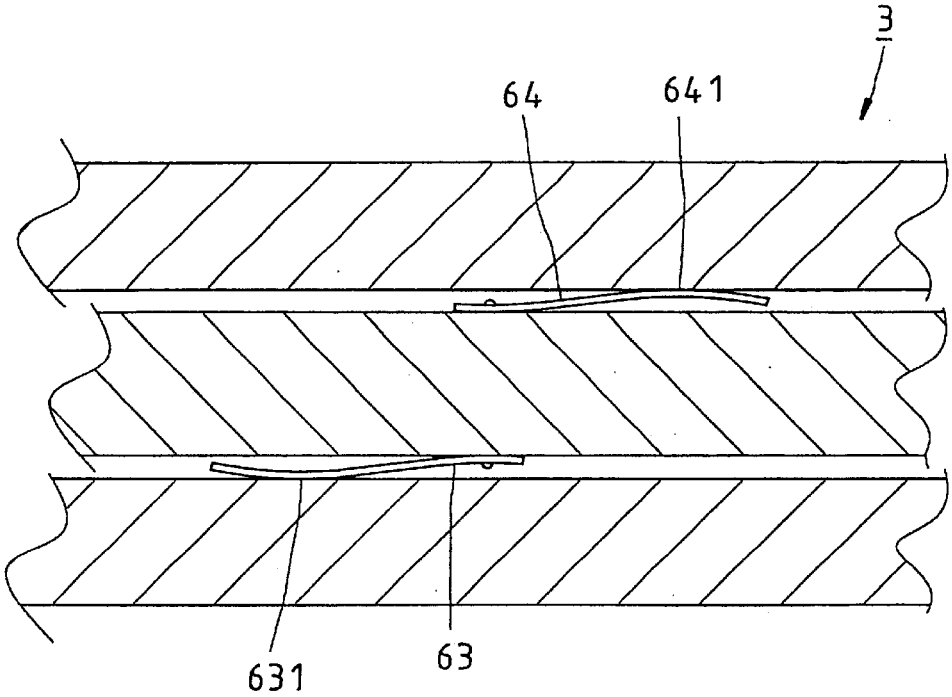
FIG. 7 shows a sectional view from the topside of the third preferred embodiment.

A third embodiment of the present invention is shown in FIG. 7, which provides a structure similar to the second embodiment. The adjustable wrench 3 has two substantially flat elastic pieces 63 and 64 each of which having only one portion 631 and 641 projecting out.

Figure 8:
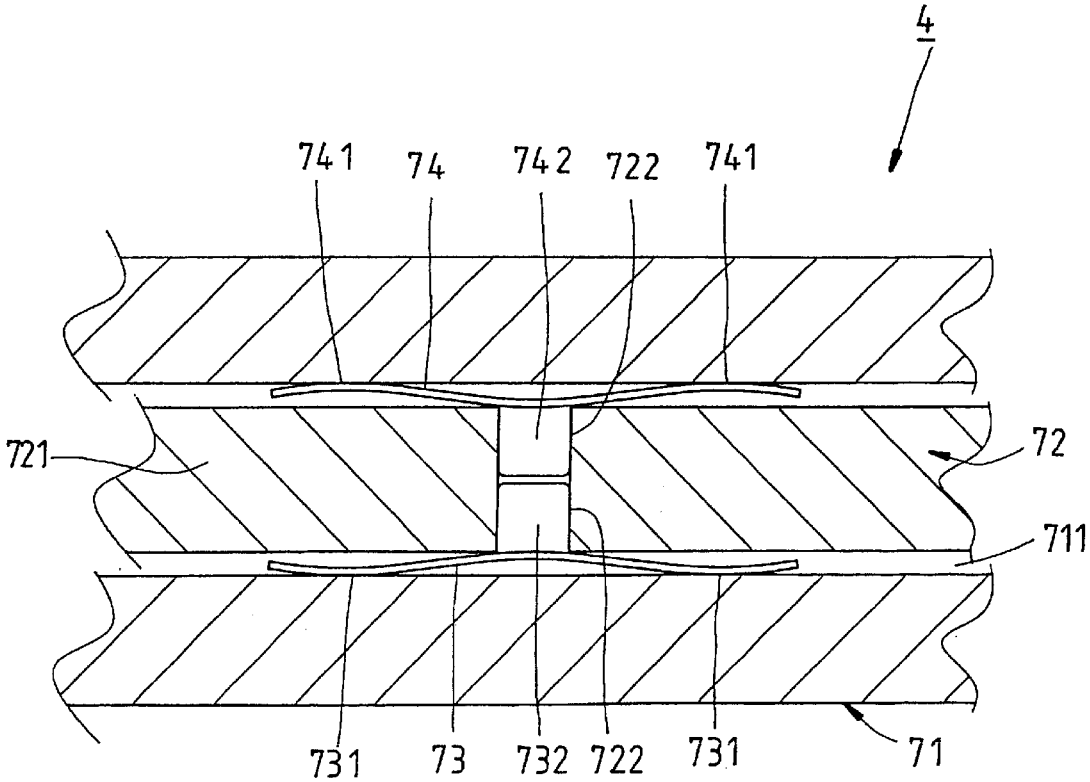
FIG. 8 shows a sectional view from the topside of the fourth preferred embodiment.

An adjustable wrench 4 of the fourth embodiment as shown in FIG. 8 comprises a frame 71 having a guiding slot 711. An adjusting jaw 72 has a neck 721 engaged in the guiding slot 711 of the frame 71. The neck 721 has a through hole 722. Two substantially flat elastic pieces 73 and 74, each of which has two portions 731 and 741 at opposite ends thereof has rods 732 and 742 each having an end respectively disposed in through hole 722. When rods 732 and 742 of the elastic pieces 73 and 74 are inserted into the through hole 722 of the adjusting jaw 72 portions 731 and 741 of the elastic pieces 73 and 74 respectively project out from adjusting jaw 72 against the sidewalls of the guiding slot 711 of the frame 71.

What is claimed is:

1. An adjustable wrench comprising:

a frame having a handle and a fixed jaw at one end of said handle, the fixed jaw having a guiding slot therein;

an adjusting jaw having a neck at bottom side thereof; said neck being slidably engaged in said guiding slot;

means for adjusting the adjusting jaw along the guiding slot;

a substantially U-shaped elastic piece engaged to said neck, said U-shaped elastic piece having two portions projecting out from the neck each slidably engaged against a sidewall of the guiding slot.

2. The adjustable wrench as defined in claim 1, wherein said U-shaped elastic piece has at least one opening and the neck has at least one block projecting out from the neck into the opening of said U-shaped elastic piece.

3. An adjustable wrench comprising:

a frame having a handle and a fixed jaw at one end of said handle, the fixed jaw having a guiding slot therein;

an adjusting jaw having a neck at bottom side thereof; said neck being slidably engaged in said guiding slot;

means for adjusting the adjusting jaw along the guiding slot;

two substantially flat elastic pieces respectively fixed to opposite side walls of said neck; each of said elastic pieces having at least one portion extending out from the neck slidably engaged against a sidewall of said guiding slot.

4. The adjustable wrench as defined in claim 3, wherein a midsection of each of said elastic pieces is fixed to the sidewall and two portions extend out from ends the midsection in slidably engagement against the sidewall of the guiding slot.

5. The adjustable wrench as defined in claim 3, wherein said neck of said adjusting jaw has a through hole; and each of said elastic pieces has a rod engaged in said through hole.

6. The adjustable wrench as defined in claim 3, wherein each of said elastic pieces is fixed to said neck by spot welding.

7. The adjustable wrench as defined in claim 3, wherein each of said elastic pieces is fixed to said neck by an adhesive.

* * * * *